US006638012B2

(12) United States Patent
Bekrenev

(10) Patent No.: US 6,638,012 B2
(45) Date of Patent: Oct. 28, 2003

(54) PLATFORM ARRANGEMENT IN AN AXIAL-THROUGHFLOW GAS TURBINE WITH IMPROVED COOLING OF THE WALL SEGMENTS AND A METHOD FOR REDUCING THE GAP LOSSES

(75) Inventor: Igor Bekrenev, Moscow (RU)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 10/006,379

(22) Filed: Dec. 10, 2001

(65) Prior Publication Data

US 2002/0085909 A1 Jul. 4, 2002

(30) Foreign Application Priority Data

Dec. 28, 2000 (RU) ..... 2000133222

(51) Int. Cl.[7] ..... F01D 5/18

(52) U.S. Cl. ..... 415/115; 415/116; 415/173.5; 416/95

(58) Field of Search ..... 415/116, 173.1, 415/173.2, 173.3, 173.4, 173.5, 173.6, 9, 174.2; 416/95

(56) References Cited

U.S. PATENT DOCUMENTS 5,044,881 A * 9/1991 Dodd et al. ..... 415/173.3
5,899,660 A * 5/1999 Dodd ..... 415/9

FOREIGN PATENT DOCUMENTS

DE 19813173 10/1998
RU 2135780 C1 8/1999

* cited by examiner

*Primary Examiner*—Edward K. Look
*Assistant Examiner*—J. M. McAleenan
(74) *Attorney, Agent, or Firm*—Burns, Doane, Swecker & Mathis, L.L.P.

(57) ABSTRACT

The invention relates to an arrangement of guide vane platforms forming the inner contour of the flow channel in an axial-throughflow gas turbine and to a method for reducing the gap losses and for the improved cooling of the wall segments. In order to avoid the disadvantages of the generic solutions, particularly to achieve reduced thermal stress on the stator housing and on the connected vane platforms and subsequently to introduce the cooling air expended for this purpose into the flow channel in such a way that the gap losses of the shrouds of the moving blades are reduced, it is proposed, according to the invention, by dispensing with heat shields, to form the inner contour of the flow channel 13 at least predominantly by means of the guide vane platforms 9 and 10 and to arrange the transitional regions 16 between the platforms 9 and 10 within the cavity 12 formed by the continuous sealing ribs 3 and 4 of the shroud 2. For this purpose, the guide vane platforms 9, 10 possess, on both sides, prolongations 9', 10', in the direction of the respectively adjacent moving blade row 1 and extend into the region delimited by its sealing ribs 3 and 4. According to a preferred embodiment, the guide vane carriers 14, 15 are designed as a hollow profile, and cooling air acts at least partially on the wall voids 17, 18, 19 formed between the stator housing and platforms. In a particularly preferred embodiment of the invention, the cooling air is introduced at least from the wall void 18 into the cavity 12 of the shroud 2 under a pressure which is above that in the surrounding flow channel 13.

7 Claims, 1 Drawing Sheet

PLATFORM ARRANGEMENT IN AN AXIAL-THROUGHFLOW GAS TURBINE WITH IMPROVED COOLING OF THE WALL SEGMENTS AND A METHOD FOR REDUCING THE GAP LOSSES

FIELD OF THE INVENTION

The invention relates to a novel design of the stator wall of an axial-throughflow gas turbine.

The invention relates, in particular, to an arrangement of the guide vane platforms forming the inner contour of the flow channel, which arrangement brings about an improved cooling of the platforms and other structural parts of the casing which are exposed to the hot gas stream and also of the cover bands of the moving blades and, furthermore, makes it possible to use the gap losses between the shrouds of the moving blades and the inner wall of the flow channel.

BACKGROUND OF THE INVENTION

Modern gas turbines operate in temperature ranges which make it indispensable to ensure intensive cooling of the turbine components directly exposed to the hot gas stream. Numerous solutions proposed by the prior art are concerned with cooling the structural parts subject to particularly high stress, such as the moving blades and guide vanes. The exposed blade regions include, in this case, the cover band elements. It is known from DE 19813173 to cool the shroud elements of moving blades by means of a row of parallel cooling bores which extend through the entire blade leaf as far as the outer edge of the shroud element and open out there into the outside space so as to form a cooling film. This shroud cooling does not influence the overflow conditions over the shroud. Since the pressure and temperature remain the same on the top side of the cover band, the top side is cooled only inadequately and is exposed to considerable thermal stress. This applies all the more to the rotating sealing ribs. On account of these difficulties, despite the inherent disadvantages in the form of increased gap losses, the first moving blade row is usually not designed with a shroud.

Other structural parts subjected to high stress are the wall segments of the flow channel, in particular the guide vane platforms and the heat shields shielding the stator housing in the region of the moving blade rows. A particular disadvantage, here, is that the joints formed at the transitional regions from one wall segment to another and the edges caused by manufacturing tolerances are exposed, undiminished, to the intensive channel flow (RU 2135780 C1). Flow deflections occur at the gaps and edges and expose these regions to particularly high thermal load. At the same time, there is the additional problem of preventing hot gases from penetrating into the interspaces between the wall segments and hot gas from acting on the vane carrier, the insides of the vane platforms and the stator housing.

It has already been proposed, in this respect, to act on these interspaces by means of compressed air which, for example, is branched off from the compressor. In this case, however, cooling air enters the flow channel through the joints between the segments in an uncontrolled manner.

SUMMARY OF THE INVENTION

The object on which the invention is based is to avoid said disadvantages of the solutions of the prior art. In particular, with the aid of the invention, reduced thermal stress on the stator housing and on the connected vane platforms is to be achieved, and the cooling air expended for this purpose is subsequently to be introduced into the flow channel in such a way that the overflow conditions for the hot gases are hindered on the shrouds of the moving blades and consequently the gap losses are reduced.

The object is achieved, according to the invention, by means of an arrangement of the type mentioned in claim 1 and a method as claimed in claim 9. The dependent claims represent advantageous developments.

The basic idea of the invention is, by dispensing with heat shields, to form the inner contour of the flow channel at least predominantly by means of the guide vane platforms and to arrange the transitional regions between the platforms within the cavity formed by the continuous sealing ribs of the cover band. For this purpose, the guide vane platforms possess, on both sides, prolongations in the direction of the respectively adjacent moving blade row and extend into the region delimited by its sealing ribs.

According to an advantageous development, the parting joint between the platforms abutting one another is sealed off by means of a preferably metallic sealing band. In a beneficial refinement, in this case, the metallic sealing band is inserted into mutually opposite slots of the mutually confronting side faces of the platforms.

According to a preferred embodiment, the guide vane carriers are designed as a hollow profile, and cooling air acts on the wall voids formed between the stator housing and platforms.

In a particularly preferred embodiment of the invention, the joint between the platforms has passage orifices for the outflow of cooling air from the wall voids into the cavity of the shroud.

In an expedient addition, the stator housing possesses a number of ducts for supplying the wall voids with compressed air. This compressed air is preferably branched off on the compressor located upstream of the gas turbine.

Individual measures of those explained above or a combination of these results in a series of advantages.

Thus, the transitional regions at particular risk between the wall segments are shifted into a less exposed region and consequently removed from the direct action of the hot channel flow. This increases their service life and hinders the penetration of the hot gases into the interspaces between the wall segments. The guide vane carrier, including platforms, and the stator housing therefore undergo lower thermal loads. Prolonging the platforms of the guide vanes beyond the vane carrier avoids the need for arranging protective heat shields. The number of wall segments in the flow channel and therefore necessarily also the number of parting joints are consequently drastically reduced. The risk of uncontrolled cooling air losses and of the penetration of hot gases through the joints between the wall segments is diminished if only because of the reduced number of wall segments.

This positive effect is further reinforced by the vane carrier being designed according the invention as a hollow profile. On the one hand, the gas-filled wall voids obtained diminish the transfer of heat on account of the insulating effect of the gas cushion and, on the other hand, cooling air can act in a controlled manner on the wall voids, so that the heat introduced is discharged from the hot structural parts. Since, according to a particularly preferred embodiment of the invention, the cooling air led through the wall voids is introduced via passage orifices within the joint between adjacent wall segments into the cavity between the sealing ribs of the cover band, this leads to a build-up of pressure within the cavity, as a consequence of which the penetration of hot gases is diminished. This results, on the one hand, in improved cooling of the shroud, in particular of the sealing ribs, and, furthermore, the gap losses caused by overflowing hot gases are reduced. In contrast to the solutions of the prior art, according to the invention the cooling air expended is utilized more than once, both for cooling the stator housing and the platforms and for cooling the shroud and, finally, for diminishing the gap losses. This has a favorable effect on the overall efficiency.

BRIEF DESCRIPTION OF THE DRAWING

An embodiment of the invention is reproduced highly diagrammatically in the drawing. The latter contains only the features essential for understanding the invention. Like elements or elements corresponding to one another bear the same reference symbol. A portion of a gas turbine with two guide vane rows and one moving blade row is illustrated in the drawing.

DETAILED DESCRIPTION OF THE INVENTION

Figure 1:
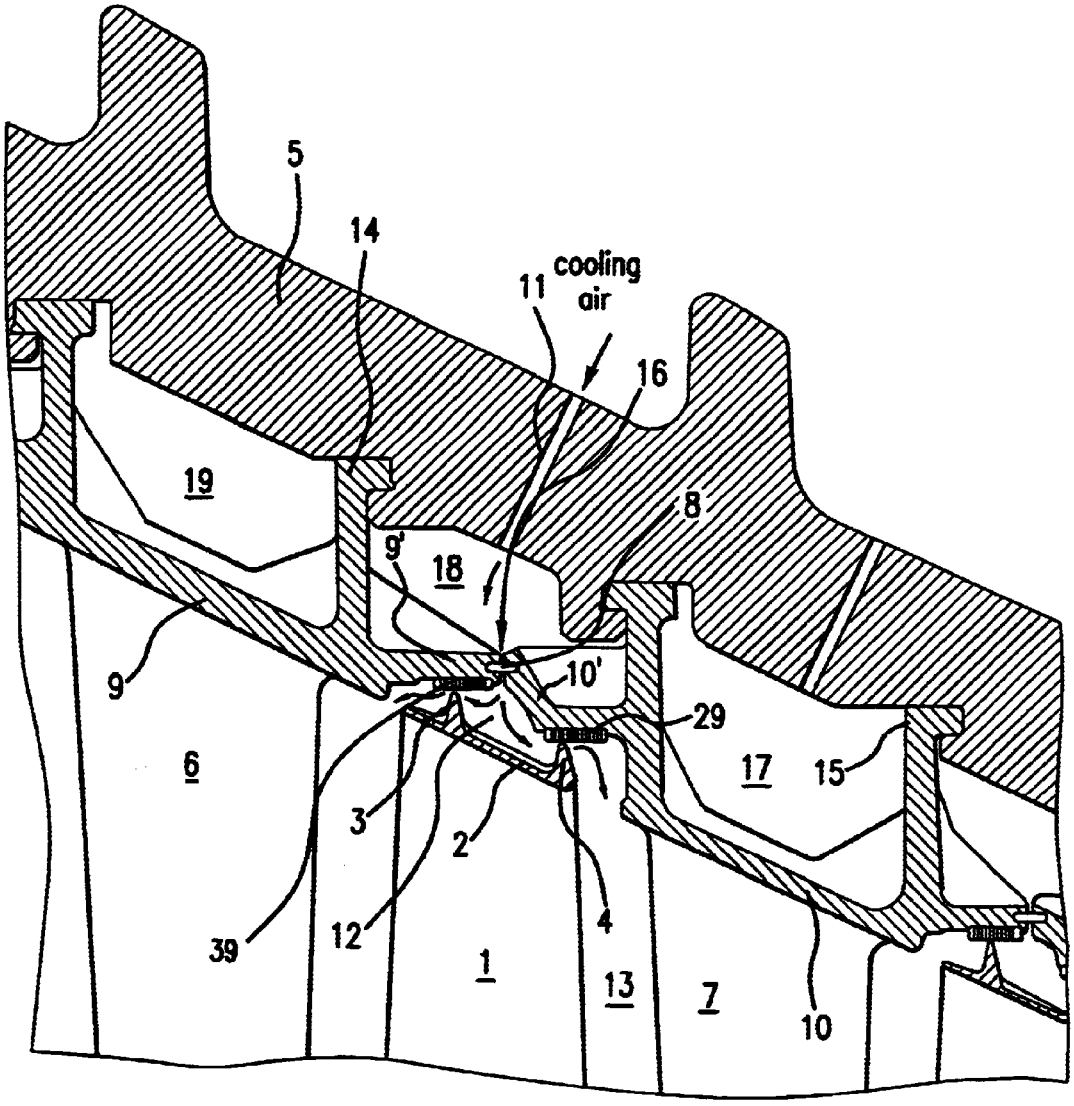

Vane carriers 14 and 15 of the guide vanes 6 and 7 are positively inserted in a way known per se into annular recesses of the stator housing 5. Between the guide vanes 6 and 7 is located the moving blade 1 connected to the rotor shaft not illustrated. In order to reduce gap losses, the tip of the moving blade 1 is provided with a shroud element 2 which, together with the shroud elements of the other moving blades of this row, forms a continuous mechanically stabilized shroud. On its top side, the shroud element 2 has sealing ribs 3 and 4 which are directed parallel to the direction of rotation of the moving blade 1 and run against sealing strips 39, 29 on the channel inner wall.

The platforms 9 and 10 of the guide vanes 6 and 7 possess on both sides, parallel to the direction of flow, portions 9' and 10' which are prolonged in the direction of the adjacent moving blade row 1 and which terminate in the region delimited by the sealing ribs 3 and 4. The sealing ribs 3 and 4 form a cavity 12 between the shroud 2 and the channel inner wall in the form of the prolonged platform portions 9' and 10'. Gas exchange with the flow channel 13 takes place via gaps between the ribs 3 and 4 and the channel inner wall. The joint 16 between the platforms 9' and 10' abutting one another is bridged by means of a metallic sealing band 8 which is inserted into mutually opposite slots of the side faces of the platforms 9, 10, in order to deny hot gases access through the joint 16 to the stator housing 5.

The guide vane carriers 14 and 15 are designed as a hollow profile, consisting of the platforms 9 and 10 forming the inner contour of the flow channel 13 and of radially outward-pointing side walls, the feet of which are guided by means of projections in recesses of the stator housing 5. The platforms 9 or 10 are spaced from the stator housing 5 according to the length of the side walls. The void 17, 19 enclosed by the hollow profile of the vane carrier 14, 15 and the stator housing 5 has a thermally insulating effect and protects the stator housing 5 from heating. In addition to these voids 17 and 19, a further void 18 is formed between the prolonged platforms 9' and 10' and the stator housing 5 and likewise preserves the stator housing 5 from the action of heat from the flow channel 13, in a similar way to the function of the protective shields known per se.

In addition, cooling air can act from outside on at least some of these voids 17, 18, 19. For this purpose, the stator housing 5 preferably has a number of circumferentially distributed cooling air ducts 11 for the supply of compressed air which, for example, may be branched off from the compressor of the gas turbine. The cooling air flows through the annular voids 17, 18 and discharges the heat introduced. The static pressure in the voids 17, 18 which are acted upon is above that in the flow channel 13, in order to rule out an overflow of hot gases. In the region of the joint 16 sealed off by means of a sealing band 8 and located between the platforms 9' and 10' abutting one another are located outflow orifices for the overflow of the cooling air at least from the adjacent void 18 into the cavity 12. The overflowing cooling air fills the cavity 12 with cooling air. This leads to an increase in the pressure in the cavity 12 and consequently exerts some blocking effect which contributes to reducing the mass flow of hot gas penetrating from the flow channel 13. At the same time, the top side of the cover band and the sealing ribs 3 and 4 are cooled effectively. The cooling air flows out on both sides via the gaps into the flow channel 13 and generates in the direction of flow a region with film cooling. Opposite the direction of flow, the thermal load on the structural parts is reduced, in the surroundings of the leading edge of the cover band 2 and of the moving blade 1, by a lowering of the mixing temperature.

LIST OF REFERENCE SYMBOLS

1 Moving blade
2 Shroud
3 Sealing rib
4 Sealing rib
5 Stator housing
6 Guide vane
7 Guide vane
8 Sealing band
9 Platform
9' Platform prolongation
10 Platform
10' Platform prolongation
11 Cooling air duct
12 Cavity
13 Flow channel
14 Guide vane carrier
15 Guide vane carrier
16 Joint between platforms abutting one another
17 Wall void
18 Wall void
9 Wall void

What is claimed is:

1. A platform arrangement of an axial-throughflow gas turbine comprises:

alternately arranged rows of stationary guide vanes and rotating moving blades in an annular flow channel, the guide vanes being connected to the stator housing of the gas turbine via vane carriers, and these vane carriers having platforms determining the inner contour of the annular flow channel and exposed to a hot gas flow, and the moving blades being equipped with shroud elements which on their top side have sealing ribs oriented in the direction of movement of the blade and running against sealing strips on an inner wall of the flow channel, wherein the platforms are arranged so as to be spaced from the stator housing and form at least predominantly the inner contour of the flow channel, said platforms having prolonged platform portions on both sides and transitional regions between the platforms of adjacent guide vane rows are arranged within the cavity formed by the continuous sealing ribs of the shroud of the moving blade row located in each case between them;

wherein each of the guide vane carriers is designed as a hollow profile, consisting of a platform forming the contour of the flow channel and of two essentially parallel side walls which are connected positively to the stator housing;

wherein cooling air acts on the voids enclosed by the guide vane carriers and/or the void enclosed between the prolonged platform portions and the stator housing; and wherein a joint between adjacent platforms has overflow orifices for overflowing cooling air from the void into the cavity.

2. The platform arrangement as claimed in claim 1, wherein the prolonged platform portions extend in the direction of the respectively adjacent moving blade row, said portions terminating in the region delimited by the continuous sealing ribs.

3. The platform arrangement as claimed in claim 1, wherein the joint between the platforms abutting one another is sealed off.

4. The platform arrangement as claimed in claim 3, wherein the platforms abutting one another have mutually opposite slots, into which a sealing band is inserted.

5. The platform arrangement as claimed in claim 1, wherein the stator housing possesses at least one duct for the supply of cooling air into at least one of the voids.

6. A method for reducing the gap losses and for the improved cooling of the structural parts, exposed to the hot gas stream, of the casing of an axial-throughflow gas turbine with alternately arranged rows of stationary guide vanes and rotating moving blades in an annular flow channel, comprising:

connecting the guide vanes to the stator housing of the gas turbine with vane carriers, said vane carriers having platforms determining the inner contour of the flow channel and exposed to the hot gas flow, and the moving blades being equipped with shroud elements which on their top side have sealing ribs oriented in the direction of movement of the blades and running against sealing strips on an inner wall of the channel, wherein cooling air acts on the cavity formed by the shroud, sealing ribs and platform portions, so that the static pressure prevailing in the cavity exceeds that of the surrounding flow channel to an extent such that cooling air overflows from the cavity into the flow channel.

7. The method as claimed in claim 6, wherein the cavity is fed from overflow orifices in or between the platforms of adjacent guide vanes.

* * * * *